United States Patent [19]

Berg

[11] Patent Number: 4,551,726

[45] Date of Patent: Nov. 5, 1985

[54] OMNI-DIRECTIONAL RADAR AND ELECTRO-OPTICAL MULTIPLE CORNER RETRO REFLECTORS

[76] Inventor: Richard M. Berg, Rte. 2, Box 2507, Stafford, Va. 22554

[21] Appl. No.: 403,682

[22] Filed: Jul. 30, 1982

[51] Int. Cl.[4] ..... H01Q 15/18

[52] U.S. Cl. ..... 343/18 C; 52/81; 52/DIG. 10

[58] Field of Search ..... 343/18 C

[56] References Cited

U.S. PATENT DOCUMENTS

| | | | |
|---|---|---|---|
| 2,763,000 | 9/1956 | Graham | 343/18 C |
| 3,039,093 | 6/1962 | Rockwood | 343/18 C |
| 3,153,235 | 10/1964 | Chatelain | 343/18 C |
| 4,096,479 | 6/1978 | Van Buskirk | 343/18 C |

FOREIGN PATENT DOCUMENTS

| | | | |
|---|---|---|---|
| 403993 | 1/1934 | United Kingdom | 52/DIG. 10 |

OTHER PUBLICATIONS

*Domebook;* Pacific Domes; 1971; pp. 7 & 9.

H. M. Cundy et al.; *Mathematical Models;* Oxford University Press; 1957, Edt.; pp. 55, 82, 86, 87, 122, 123, 136 and 137.

*Primary Examiner*—T. H. Tubbesing

*Attorney, Agent, or Firm*—John E. Becker; Robert P. Gibson; Anthony T. Lane

[57] ABSTRACT

Methods for making and assembling various orthogonal multifaceted polydeltatrihedral self-supportable corner reflectors. Planar two-dimensional network or pattern products and orthogonal polyhedra products-by-process evolving from the various methods find unique applicability in the radar industry, the educational toy industry, the navigation aid/hazardous warning industry, and the lighting industry.

27 Claims, 38 Drawing Figures

TETRACAIDECADELTATRIHEDRAL

TETRACAIDECADELTATRIHEDRAL NETWORK

FIG. 1
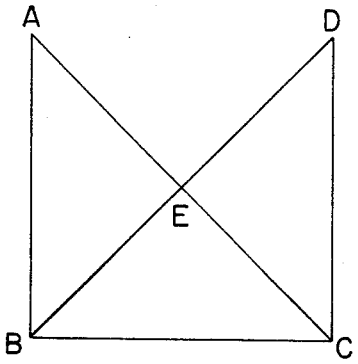
DUODELTATRIHEDRAL
FIG. 2a
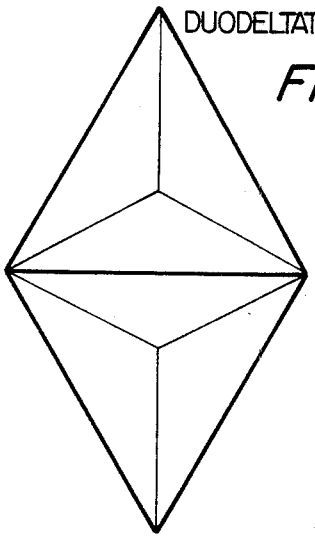
OCTADELTATRIHEDRAL
FIG. 2b
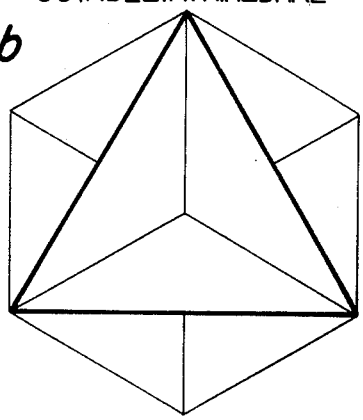
TETRACAIDECADELTATRIHEDRAL
FIG. 2c
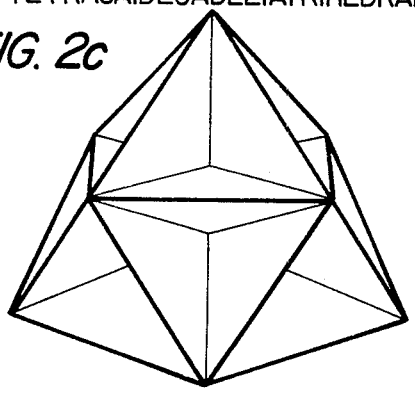
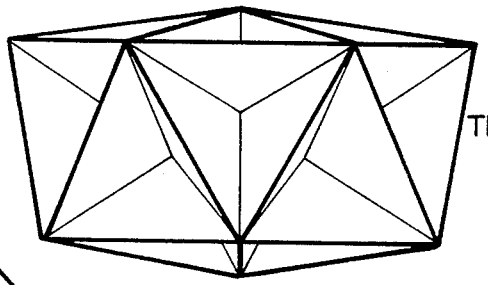
TETRAICOSADELTATRIHEDRAL
FIG. 2f
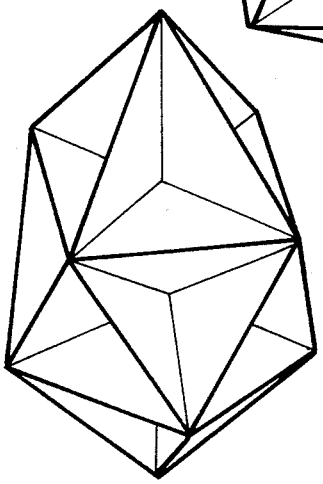
HEXACAIDECADELTATRIHEDRAL
FIG. 2d
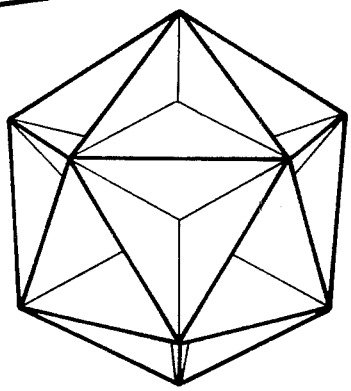
ICOSADELTATRIHEDRAL
FIG. 2e

DUODELTATRIHEDRAL NETWORK

OCTADELTATRIHEDRAL NETWORK

TETRACAIDECADELTATRIHEDRAL NETWORK

HEXACAIDECADELTATRIHEDRAL NETWORK

ICOSADELTATRIHEDRAL NETWORK

TETRAICOSADELTATRIHEDRAL NETWORK

SECOND ORDER TESSELATION NETWORK OF THE DELTATRIHEDRAL

SECOND ORDER TESSELATION

SECOND ORDER TESSELATED NETWORK FOR THE ICOSADELTATRIHEDRAL

THIRD ORDER ICOSADELTATRIHEDRAL

SECOND ORDER ICOSADELTATRIHEDRAL

FOLDED REFLECTOR

EXTEND RIGHT AND LEFT FLAPS

EXTEND FRONT AND BACK "SWALLOWTAILS"

RAISE REMAINING 4 TRIANGLE PANELS ON RIGHT, LEFT AND TOP FLAPS

JOIN TRIANGLE PANELS ON EACH "SWALLOWTAIL"

FOLD SIDE FLAPS DOWN UNTIL EDGES INTERSECT WITH EDGES ON FORMED "SWALLOWTAILS"

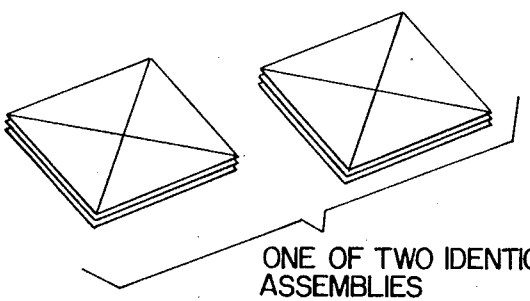
ONE OF TWO IDENTICAL ASSEMBLIES
FIG. 11a
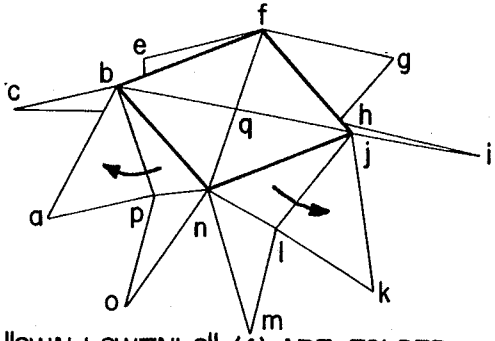
"SWALLOWTAILS" (4) ARE FOLDED OUT FROM UNDER CENTER SQUARE PLATE
FIG. 11b
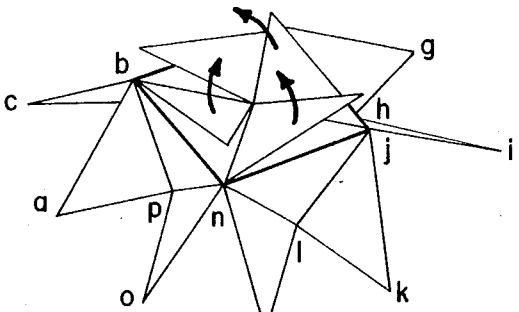
RAISE 4 TRIANGULAR PANELS FROM CENTER PLATE FORMING FOUR CORNERS
FIG. 11c
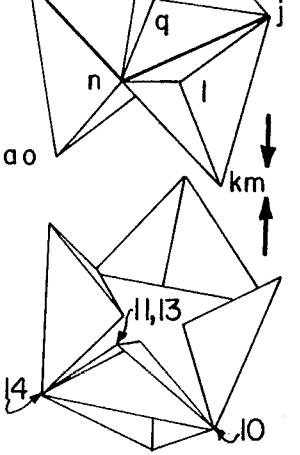
JOIN TRIANGULAR PANELS ON EACH "SWALLOWTAIL"
FIG. 11d
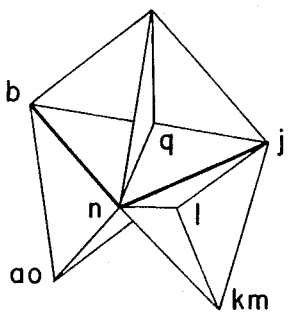
COMPLETED HALF OF ASSEMBLY
FIG. 11e
INVERT AND TWIST SECOND ASSEMBLY 45° AND MESH WITH OTHER
FIG. 11f
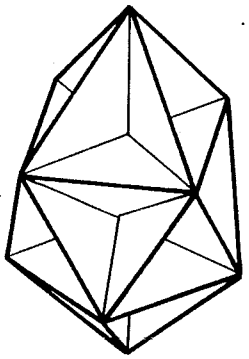
FIG. 11g

OMNI-DIRECTIONAL RADAR AND ELECTRO-OPTICAL MULTIPLE CORNER RETRO REFLECTORS

GOVERNMENT INTEREST

The invention described herein may be manufactured and used by or for the United States Government for governmental purposes without the payment of any royalties therefor or thereon.

BACKGROUND AND OBJECTS OF THE INVENTION

The present invention relates to a method of assembling from a network of deltatrihedrals a multifaceted corner polyhedra reflector and, more specifically, to a network and method of constructing polydeltatrihedral corner reflector having three mutually perpendicular intersecting planes.

It is a well known phenomenon that a triplanar corner formed by the intersection of three mutually perpendicular planes will focus and redirect radar energy directly back toward the source. The term "corner reflector" as known in the art is typically utilized for marking obstructions, serving as navigation points and for radar purposes. In its most typical configuration, a radar reflector polyhedron, referred to as an octahedron, is formed from eight such corners and provides eight maximum reflecting lobes within a circumscribed sphere, each lobe consisting of a 40° cone. The present invention provides a novel system for assembling any number of similar configurations, some of which have never been considered, until now, for use in the manner herein prescribed.

A theoretically perfect omnidirectional radar reflector reflects incident waves uniformly in all directions and takes the form of a sphere. However, the convex reflective surface which a sphere presents to incident waves for the most part reduces the percentage of transmitted energy which is reflected back to a receiver. It has been determined that the theoretical optimum retrodirective response of a reflector is produced by a perfectly conductive planar member in which the incident radar energy is transmitted toward the plane normal thereto. However, such a reflector is considered to be extremely directional, and even a slight departure from the normal axes produces a substantial reduction in the usable reflected energy.

An omindirectional radar corner reflector, for example, has been developed wherein an array of twenty trihedral corners, i.e., three planes each mutually perpendicular, are distributed on the surface of a sphere as described in U.S. Pat. No. 3,039,093. The solid formed by this configuration is referred to as an icosahedron corner reflector, being a variation of the regular polyhedron referred to as an icosahedron, wherein each of the trihedrals consists of mutually perpendicular planes having an open frontal face projection of an equilateral triangle. The icosahedral corner reflector described by the instant patent is constructed of a plurality of triangular corner reflectors disposed in an edge-to-edge relationship such that the outer edges thereof from a portion of the resulting icosahedron conforming to a quasi-spherical shape. Twenty right trihedrals are assembled in edge-to-edge relationship with their apexes directed inwardly toward a common center and the planes of their outer edges defining an icosahedron. Corner reflector trihedrals having equilateral triangle face plane projections are referred to hereinafter as deltatrihedrals.

Although the above-described omnidirectional icosahedral radar reflector has been found useful in its functional capacity, the method of assembly is entirely restrictive. The manner of construction appears to describe a method whereby twenty individual corner reflectors (i.e., deltatrihedrals) are prepared and assembled accordingly to provide the particular configuration. Such an approach is cumbersome, time-consuming and relatively expensive and, therefore, a more expedient and economical approach in the fabrication of this particular icosahedron radar reflector as well as a family of similar multifaceted test devices would be highly desirable.

Therefore, it is an object of the present invention to provide a method of fabricating an omnidirectional orthogonal polydeltatrihedral having 90° reentrant triplanar cavities; which will overcome the above-noted and other disadvantages.

It is a further object of the present invention to provide a method of constructing an omnidirectional corner reflector configuration of a compact, collapsible nature, one that is amenable to both rigid construction and inflatable construction.

A further object of the present invention is to provide an omindirectional radar reflector which can be folded into a compact assembly for ease in storage and transportation.

Yet, a further object of the present invention is to provide a method of fabricating a three-dimensional omnidirectional radar reflector from a two-dimensional network.

Yet, still another object of the present invention is to provide novel deltatrihedral corner reflectors.

Still a further object of the present invention is to provide a method of manufacturing an omnidirectional radar corner reflector having a reflector response as uniformly close to a perfect sphere as theoretically possible.

BRIEF SUMMARY OF THE INVENTION

The foregoing objects and others are accomplished in accordance with the present invention, generally speaking, by providing a method for constructing a geometric solid or enclosed configuration representing an orthogonal polydeltatrihedral. The deltatrihedral is a variation of the deltahedra which is a convex polyhedra whose faces or surfaces consist entirely of plane equilateral triangles. The deltatrihedral as defined herein refers to a trihedral comprising three orthogonally assembled planes whose open frontal face is a projection of an equilateral triangle. A single deltatrihedral is constructed of three right isosceles triangles, hinged together such that they have a common vertex formed by the mutual coincidence of the individual apexes of each triangle. The three adjoining triangles may constitute a subpattern. Folding the triangles along their common edges in the same direction forms a triplanar cavity known as a deltatrihedral or corner reflector. The frontal face projection of the resulting trihedral forms an equilateral triangle. The proper placement of these individual trihedral patterns into a defined network provides the basis for constructing all members of the deltatrihedral family. By the continuous joining of edges in the assembly of the network of deltatrihedrals a continuous solid surface comprising the deltatrihedral corner reflectors, which is a stellated polyhedra, corresponding to the number of patterns defining the network is produced. The family of orthogonal polydeltatrihedral corner reflectors and their related orders of tesselations defined by the present invention opens the door to an entirely new spectrum of radar reflecting devices. The equilateral triangular facings have the capability of being subdivided or tesselated into infinitely smaller trihedrals.

BRIEF DESCRIPTION OF THE DRAWINGS

The invention is further illustrated by way of the accompanying drawings which are intended to illustrate but not limit the subject matter of the present invention, and wherein:

FIG. 1 represents the basic deltatrihedral developed planar pattern from which the polydeltatrihedral corner reflectors of the present invention are fabricated;

FIGS. 2*a*–2*f* illustrate several representations of polydeltatrihedral corner reflectors of the present invention;

FIGS. 10*a*–10*c* and 11*a*–11*g* represent an alternate method of assembling the hexacaidecadeltatrihedral corner reflector array.

DETAILED DESCRIPTION OF THE INVENTION

Figure 3A:
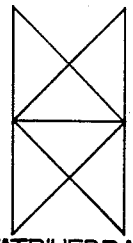
FIGS. 3*a*–3*f* illustrate the networks from which the developed planar patterns or specified polydeltatrihedral reflectors of FIGS. 2*a*–2*f* are assembled.

Referring now to FIG. 1, there is seen a single deltatrihedral developed planar pattern from which a single deltatrihedral corner reflector is constructed. The right isosceles triangles AEB, DEC and BEC are joined together at edges BE and CE. By folding triangle AEB upward along edge BE and triangle DEC upward along edge CE, edges AE and DE merge into a common edge which when permanently fixed or hinged forms a triplanar cavity referred to as a trihedral corner reflector. The front face projection of this trihedral configuration inscribes an equilateral triangle (B)·(AD)·(C), wherein AD represents the common vertex formed by joining edges AE and DE.

FIGS. 2*a*–2*f* illustrate several of the polydeltatrihedral corner reflector configurations produced according to the process of the present invention constructed by the basic pattern represented in FIG. 1. FIG. 2*a* represents a duadeltatrihedral (2), FIG. 2*b* represents an octadeltatrihedral (8), FIG. 2*c* represents a tetracaidecadeltatrihedral (14), FIG. 2*d* represents a hexacaidecadeltatrihedral (16), FIG. 2*e* represents a icosadeltatrihedral (20), and FIG. 2*f* represents a tetraicosadeltatrihedral (24) configuration. FIGS. 3*a*–3*f* illustrate the various networks from which the polydeltatrihedral configurations of FIGS. 2*a*–2*f* are fabricated. In the assembly of the specified polydeltatrihedrals all lines and edges when merged form a continuous solid surface deltatrihedral (concave) corner reflector. To assemble the respective configurations the diagonal edges are folded upward and the horizontal and vertical edges are folded downward. All exposed edges will join together and are fastened to form the deltatrihedral cavities. The respective networks of FIGS. 3*a*–3*f* are assembled into the first order deltatrihedrals of FIGS. 2*a*–2*f*.

Figure 3B:
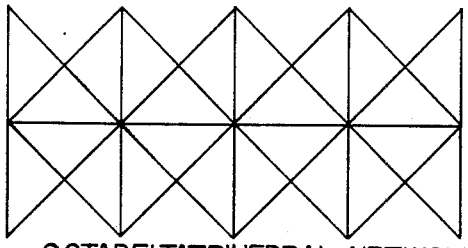
Figure 3C:
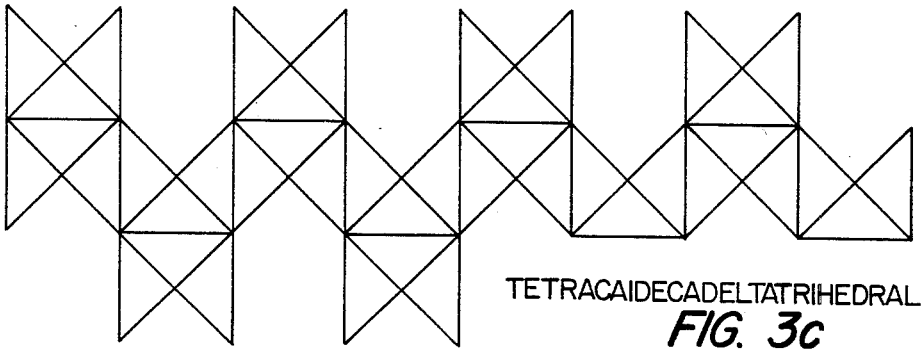
Figure 3D:
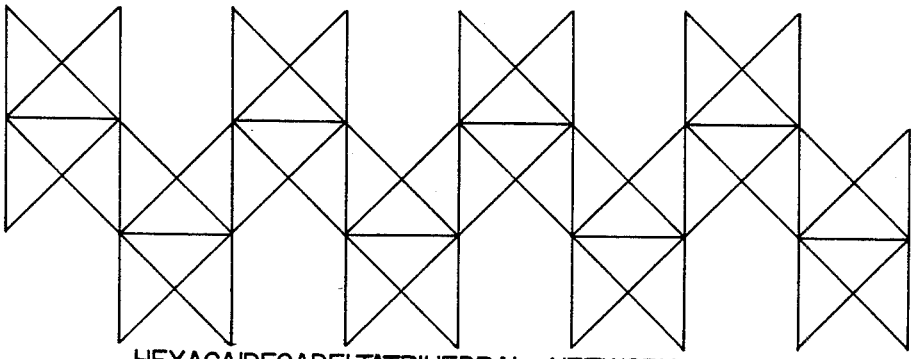
Figure 3E:
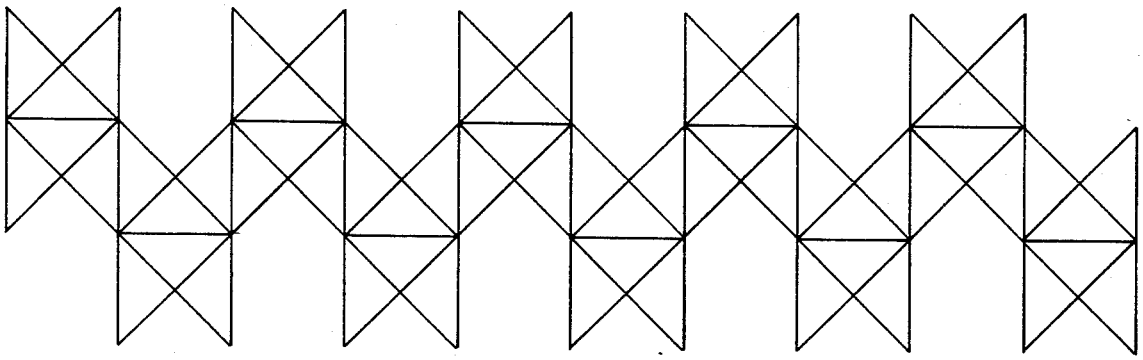
Figure 3F:
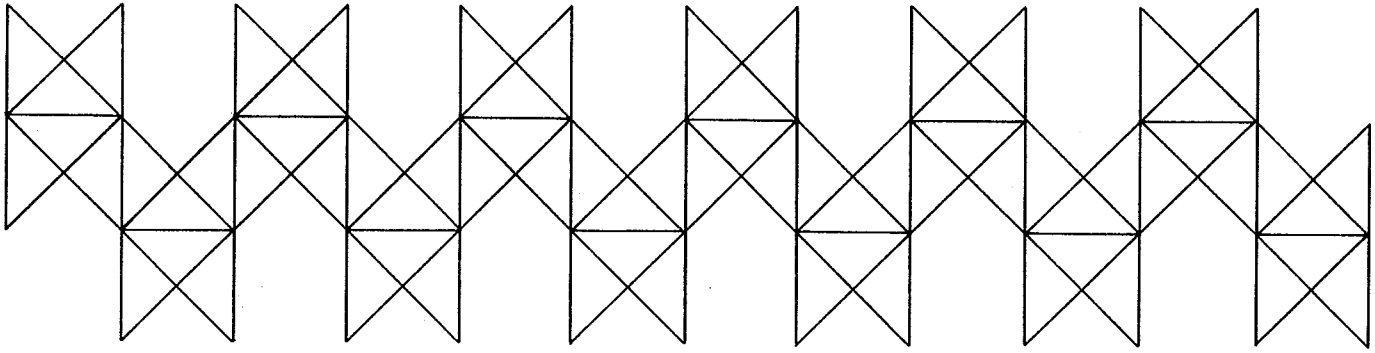
Figure 4B:
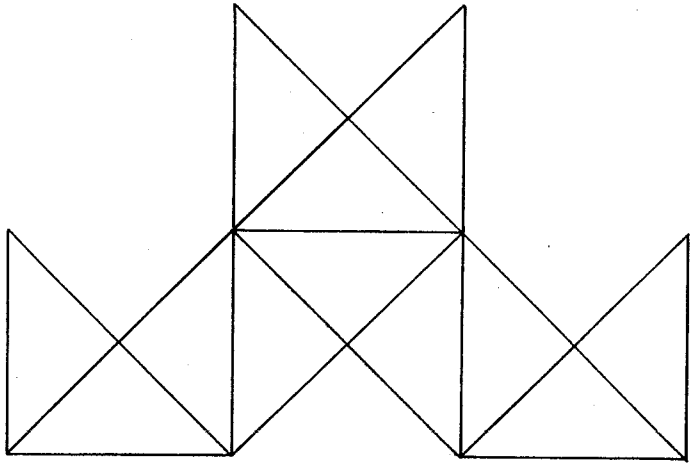
FIG. 4*a* represents the basic second order subdivision (tesselation) of the plane equilateral triangle, and FIG. 4*b* the network for the second order tesselation of the analagous deltatrihedral.
Figure 4A:
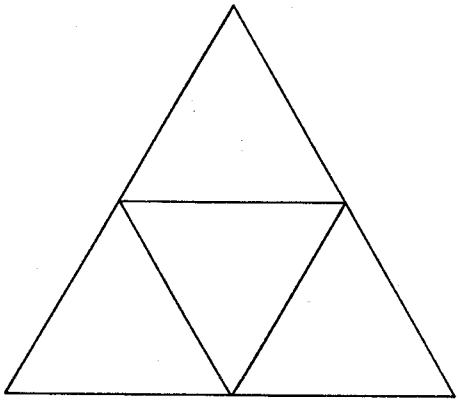
Figure 5A:
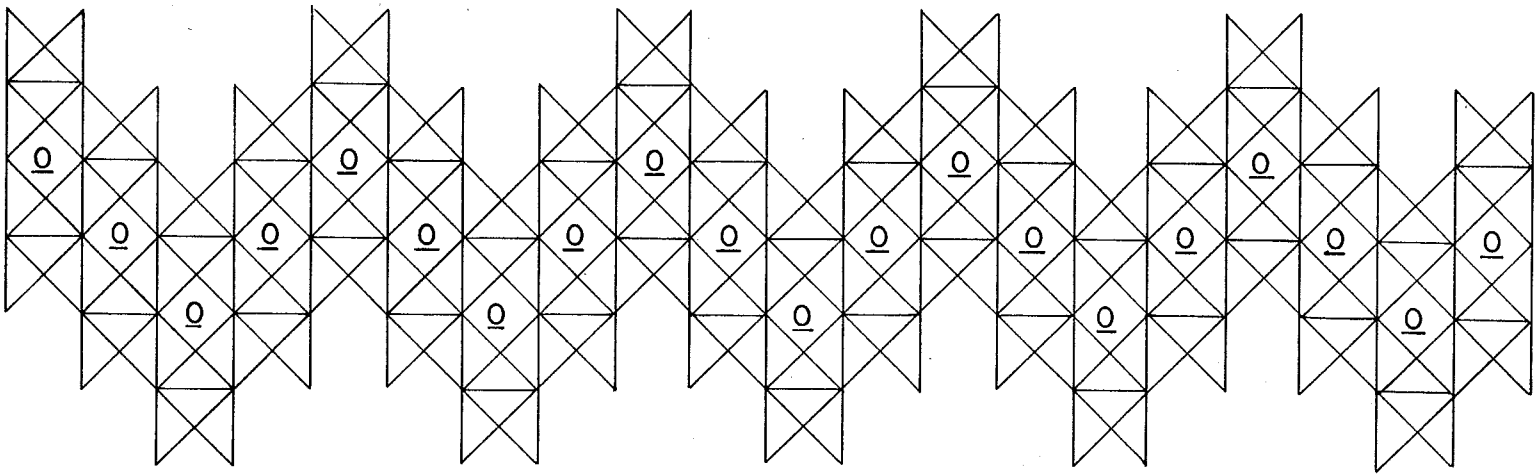
FIGS. 5*a* and 5*b* represent a second order tesselated network for the icosadeltatrihedral and corresponding assembled 80 corner array.
Figure 5B:
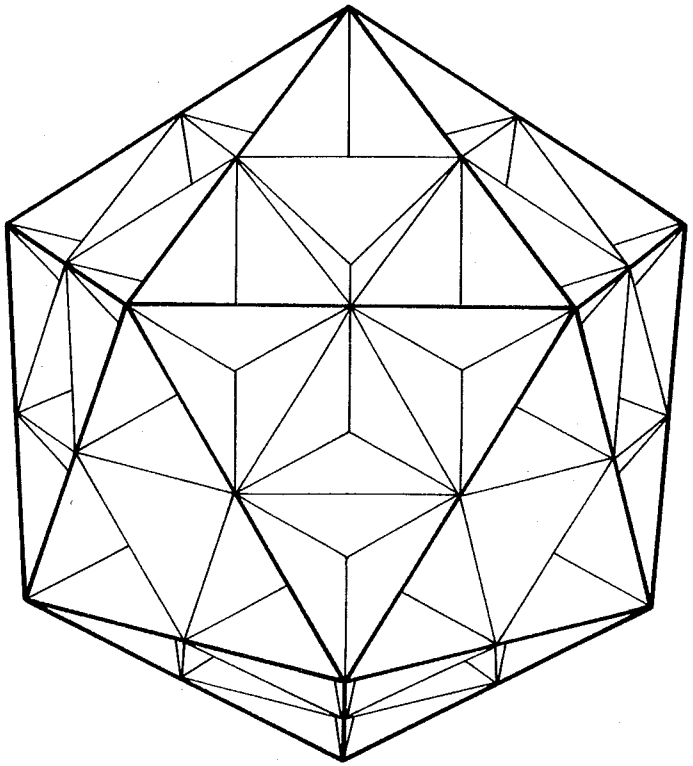

FIG. 4*a* illustrates a developed planar two dimension equilateral pattern surface with each side of the triangle bisected in a second order subdivision, and FIG. 4*b* illustrates the corresponding deltatrihedral second order tesselation network. Thus, replacing the deltatrihedral configuration of FIG. 1 with that of FIG. 4*b* and inserting the resulting network for each deltatrihedral network of FIGS. 3*a*–3*f*, a polyhedra will result in which the number of corner reflector cavities is four times that of the originals, FIGS. 2*a*–2*f*. When assembled the network of FIG. 4*b* consists of four smaller deltatrihedrals within an equilateral triangle. FIG. 5*a* represents a planar pattern or network of a second order tesselated network for the icosadeltatrihedral, with the appropriate network substitution taking place and FIG. 5*b* represents the assembled second order icosadeltatrihedral of FIG. 5*a* comprising eighty deltatrihedrals. The areas identified as O in FIG. 5*a* stand for open areas.

Figure 6:
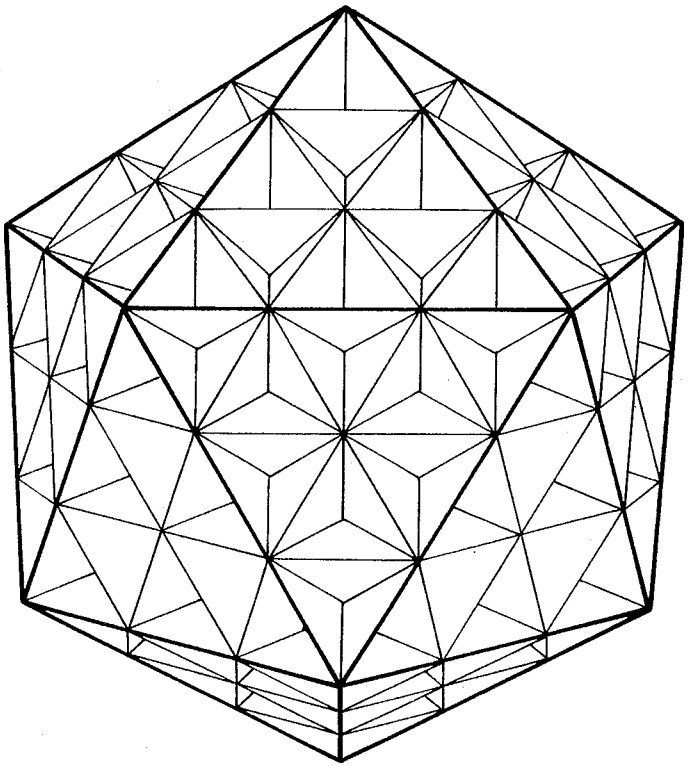
FIG. 6 represents a third order tesselation of the icosadeltatrihedral having 180 corners.

Similarly, by trisecting the edges of an equilateral triangle, nine smaller equilateral triangles are formed. By using smaller techniques as discussed above with respect to FIGS. 4*a* and 4*b*, the resulting network representing the third order tesselation is fabricated into a corresponding collection of deltatrihedral corner reflectors and substitution of the resulting configuration for the original first order tesselation resulting from the basic network of FIG. 1 produces a third order 180 corner icosadeltatrihedral structure represented by FIG. 6.

The tetraicosadeltatrihedral of FIG. 2*f* constructed from the network of FIG. 3*f* is derived from a semiregular antiprism core having a central belt of 12 alternating equilateral triangles and open ends that are projections of hexagons. This 24 cornered solid surface reflector is obtained by replacing each equilateral triangle by a deltatrihedral and filling the hexagonal ends with six deltatrihedrals (i.e., hexadeltatrihedral). It is also further possible to construct a configuration of an unlimited number of the core sections stacked in series, of which there are two such core sections identified in FIG. 7, with the terminal hexagonal faces capped by the beforementioned six deltatrihedrals. For antiprisms having central cores with more than twelve deltatrihedrals, the open end polygon projections are no longer hexagon and the trihedrals formed have a frontal face projection of isosceles triangles rather than equilateral triangles.

Figure 8C:
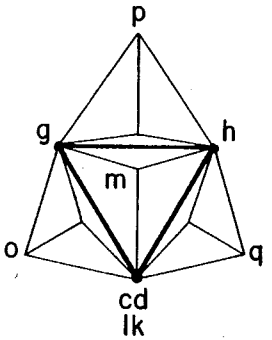
FIGS. 8*a*–8*c* and 9*a*–9*f* represent an alternate method of assembling the tetracaidecadeltatrihedral corner reflector array.
Figure 8A:
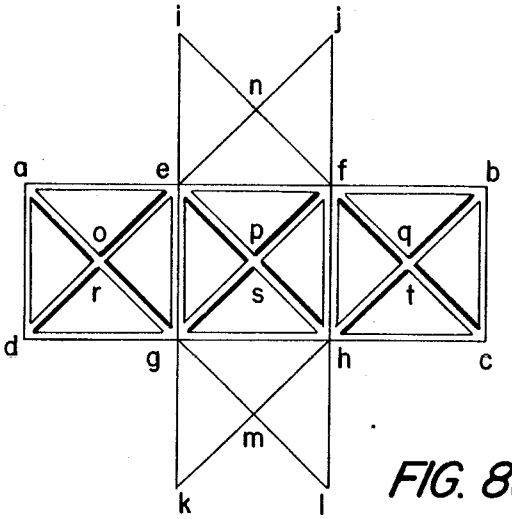
Figure 8B:
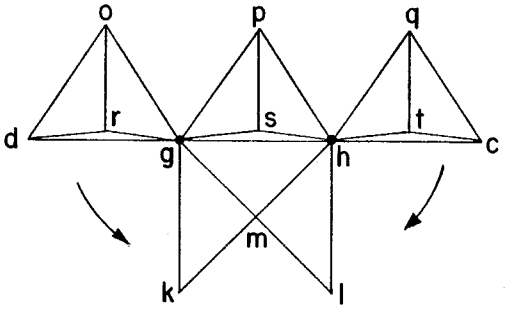

Referring now to FIGS. 8*a*–8*c*, there is represented in FIG. 8*a* an extended top view wherein three square reflecting plates adge, eghf, and fhcb are hinged along edges $\overline{eg}$ and $\overline{fh}$. On the top of each square plate are four 45° right triangles hinged along the heavy dark lines as represented. Adjoining edges $\overline{ef}$ and $\overline{gh}$ are deltatrihedral networks indicated in FIG. 1. When each of the four right triangles per square plate are lifted up about the hinges the four elevated edges will merge forming four trihedral corners per plate. The folded three plates produce twelve of the fourteen trihedrals of the forementioned tetracaidecadeltatrihedral with the remaining two being formed from the upper and lower deltatrihedral networks when edges $\overline{in}$ and $\overline{jn}$ and $\overline{km}$ and $\overline{lm}$ are joined. By folding the right and left plates down and behind the center plate, edges $\overline{ad}$ and $\overline{bc}$ will merge and be joined. The upper and lower trihedral corners are folded down and behind the center plate such that edges $\overline{ae}/\overline{ie}$, $\overline{bf}/\overline{jk}$, $\overline{ch}/\overline{lh}$ and $\overline{dg}/\overline{kg}$ will merge and be joined together. FIG. 8*b* represents a front view of the partially assembled deltatrihedra and FIG. 8*c* a frontal perspective view of the completely assembled tetracaidecadeltatrihedral. FIGS. 9*a*–9*f* represent a stepwise pictoral description for assembling the tetracaideltatrihedral according to the alternate procedure of FIGS. 8*a*–8*c* accompanied by verbal description.

Figure 10A:
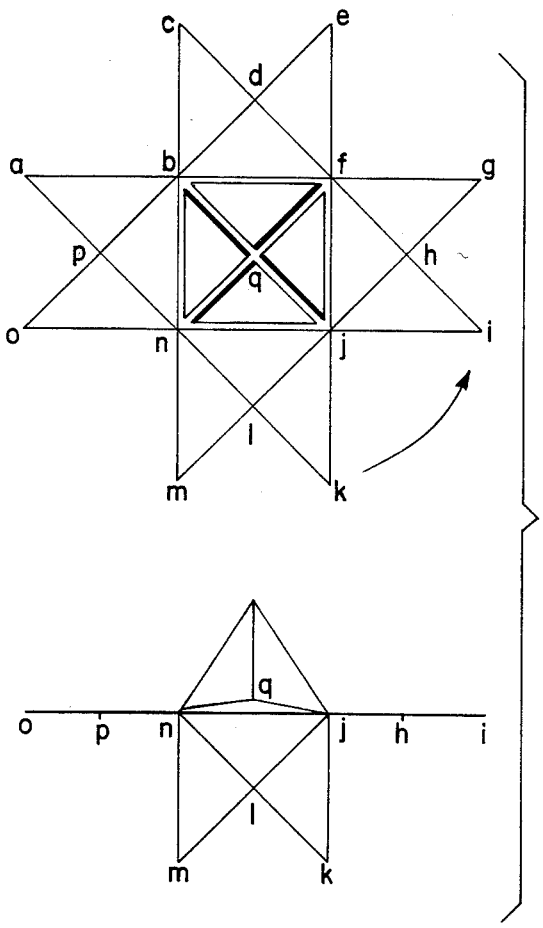
Figure 10B:
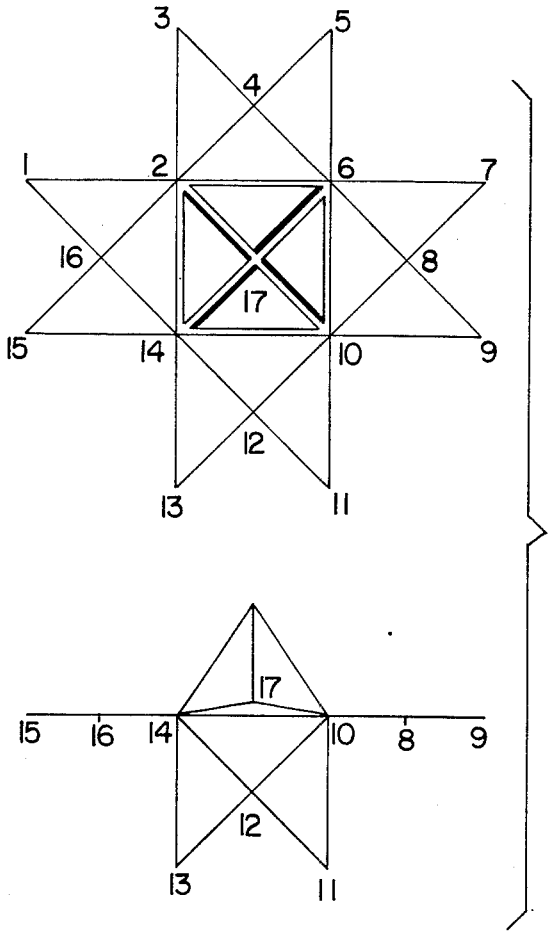
Figure 10C:
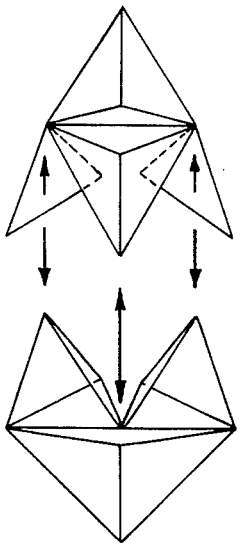

For the hexacaidecadeltatrihedral there is illustrated a pair of networks 10*a* and 10*b* consisting of a single square plate having on each edge a deltatrihedral network as represented in FIG. 1 and on the top of each plate four hinged right triangles as described above hinged at the dark lines. Each network pair forms an eight corner trihedral reflector and when joined along their exposed edges as in FIG. 10*c* form the sixteen cornered hexacaidecadeltatrihedral. FIGS. 10*a* and 10*b* are shown in both a top view (extended) and frontal view (partially assembled). FIGS. 11*a*–11*g* represent a stepwise pictoral description for assembling the hexacaidecadeltatrihedral according to the alternate procedure of FIG. 10*a*–10*c* accompanied by the appropriate verbal description.

In accordance with the present invention, certain members of the deltahedra family cannot be constructed as first order polydeltatrihedral because of insufficient internal volume, such as the pentagonal dipyramid. However, this is not necessarily true of the second order and higher tesselations. Thus, an entire class of polyhedra can be constructed as omnidirectional corner reflectors depending upon the degree and distributions of reflection desired.

Any suitable material may be utilized from which the radar reflector of the present invention may be fabricated such as metal sheet, wire mesh, or cardboard and plastic with the outer surfaces metallized. The edges of the respective triangles and triplanar cones in the construction of a practical configuration may be permanently joined by hinges, such as door hinges or piano hinges, tape, suitable adhesives or the like. Inexpensive reflectors can be constructed of metallized plastic film for the triangular planes and rolled paper for edge struts. Such a configuration is collapsible and can be folded with edges joined so as to form airtight seals and, as such, are inflatable. In use the reflector can be attached to a naturally low reflecting object and mark the presence of hazards and obstacles. To appear on a radar screen as a moving target, the reflector can be spun at a known angular rate and, thus, the object will be identifiable. If a random velocity is desired, the specific corner reflector can be inserted at the tip end of a flexible pole, such as a fiberglas rod, that is anchored to the base and permitted to whip around in the wind. Depending upon the length of arc of travel, the tip velocity desired will determine the flexibility of the rod. Because of the approximately 70 percent maximum radar cross-section viewing available, the reflector is ideally suited in providing a moving target radar return regardless of the angular attitude of the flexible rod. If mounted on a vehicle, it will serve the purpose as a decoy and tend to shift the target centroid away from the vehicle and towards the reflector.

A unique application of a moving reflector is in a linear array along the ground, that is, one reflector per radar resolution cell. In this application runways and roads may be marked and will appear as line segments on a radar display. It should be pointed out that in such an application moving vehicles traveling beneath the array may be masked to the radar, especially if the velocity of the reflector exceeds that of the vehicle traffic.

It has been determined in the course of the present invention that multifaceted omnidirectional corner reflectors may be assembled from planar surfaces, a fact which permits the manufacturing of the radar reflector by a continuous process. The corner array reflector of the present invention can be folded into a compact assembly for storage and transportation and reassembled into the reflector array as defined for ready utilization.

Although the subject matter of the present invention has been discussed primarily in a specific application to the construction of radar reflecting devices, the invention is equally applicable to the toy industry specifically of the educational variety. The networks defined above can be utilized to teach small motor coordination in children as well as geometrically express a three dimensional form of the products produced thereby.

Furthermore, the numerous geometrical configurations obtainable by the processes disclosed are useful for ornamental purposes such as lighting fixtures and chandeliers since the same reflecting surfaces that retroreflect radar energy can retroreflect light energy from the highly polished surfaces. It does not matter whether the source of light energy is from the conventional incandescent bulbs or directed from a laser.

The invention being thus described, it will be obvious that the same may be varied in many ways. Such variations are not to be regarded as a departure from the spirit and scope of the present invention, and all such modifications to be included within the scope of the following claims.

What is claimed is:

1. A method of making and assembling any of various member units of a family of multifaceted self-supportable orthogonal polyhedra corner reflectors, exclusive of the Octahedral and Icosahedral, analogous to a stellated polyhedra but differing therefrom by having 90° reentrant angles; said method comprising the steps of:

(a) selecting at least a semi-rigid planar sheet material provided with a reflective surface capable of reflecting radar waves, and capable of being self supporting in the assembled condition;

(b) designing a two dimensional unitary pattern or network on said sheet material for each family member unit reflector, which unitary patterns or networks are adaptable to be folded and formed into interconnected clusters of deltatrihedral reflectors;

(c) said designing of said patterns including (1) delineating plural groups of three uniform size, interconnected 45° right constituent triangles, each group of which constitutes a subpattern for a potential deltatrihedral corner reflector or facet portion of the overall polydeltatrihedral reflector, and (2) arranging said groups of triangles so as to have a pronounced orthogonal rows and columns arrangement whereby the hypotenuse delineations of certain triangles have vertical orientation and others have horizontal orientation, and further (3) delineating the sides of all of said triangles to have 45° diagonal orientation such that the delineated sides of each constituent group of three triangles form a 90° "X" delineation;

(d) cutting the network from said sheet material so as to have a unitary orthogonal rows and columns outline in which certain of the said constituent triangle sides and hypotenuses constitute free edges of said network, and terminating each column with at least one 90° "V"-shape free edge;

(e) providing potential fold or hinge line means on at least each of the horizontal, vertical and diagonal delineations which constitute internal non-free-edges of said patterns/networks; and (f) folding and manipulating said triangular panels and said overall network including adjoining appropriately related free edges so as to assemble each network into 90° reentrant deltatrihedral reflectors to produce a closed polydeltatrihedral corner reflector cluster embodying a preselected number of said 90° deltatrihedrals.

2. The method of claim 1, wherein said step (c) further includes arranging the columned plural groups of said triangles in an alternating essentially back-to-back arrangement for most pairs thereof; and arranging at least most of the columns thereof in an alternately vertically offset manner to one another.

3. The method of claim 1, wherein said designing and delineating step (c) includes delineating plural groups of said 45° right triangles into fourteen deltatrihedral subpatterns and arranging them in alternating and offset rows and columns so as to constitute a network for a tetracaidecadeltatrihedral as depicted in FIG. 3*c* and resulting in the product of FIG. 2*c*.

4. A tetracaidecadeltatrihedral corner reflector, with all 90° reentrant angles, produced according to the method of claim 3.

5. The method of claim 1, wherein said designing and delineating step (c) includes delineating plural groups of said 45° right triangles into sixteen deltatrihedral subpatterns, and arranging them in alternating and offset rows and columns so as to constitute a network for a hexacaidecadeltatrihedral, as depicted in FIG. 3*d* and resulting in the product of FIG. 2*d*.

6. A hexacaidecadeltatrihedral corner reflector, with all 90° reentrant angles, produced according to the method of claim 5.

7. The method of claim 1, wherein said designing and delineating step (c) includes delineating plural groups of said 45° righ triangles into twenty deltatrihedral subpatterns, and arranging them in alternating and offset rows and columns so as to constitute a network for an icosadeltatrihedral, as depicted in FIG. 3*e* and resulting in the product of FIG. 2*e*.

8. The method of claim 1, wherein said designing and delineating step (c) includes delineating plural groups of said 45° right triangles into twenty-four deltatrihedral subpatterns, and arranging them in alternating and offset rows and columns so as to constitute a network for a tetraicosadeltatrihedral, as depicted in FIG. 3*f* and resulting in the product of FIG. 2*f*.

9. A tetraicosadeltatrihedral corner reflector, with all 90° reentrant angles, produced according to the method of claim 8.

10. The method of claim 1, wherein said designing and delineating step (c) includes:

arranging predetermined groups of said 45° right triangles into predetermined numbers of alternating and offset rows and columns according to preselected desired number of deltatrihedral corner reflector facets, and furthermore cutting out 90° diamond shaped openings in medial portions of at least certain of alternating vertical columns to facilitate the manipulating into the desired finished reflector product.

11. The method of claim 1, wherein said designing and delineating step (c) includes delineating plural groups of said 45° right triangles into eighty deltatrihedral subpatterns and arranging them in alternating and offset rows and columns so as to constitute a network for a second order tesselated network for an icosadeltatrihedral, as depicted in FIG. 5*a* and resulting in the product of FIG. 5*b;* and wherein said step (c) further includes cutting out diamond shaped openings in medial portions of each of said vertical columns, as shown in FIG. 5*a*, to facilitate the manipulating into the finished reflector shown in FIG. 5*b*.

12. The method of claim 1, wherein the folding and manipulating of step (f) thereof includes the folding upwardly of the respective constituent triangles or facets about said diagonal delineations and folding backwardly about said vertical and horizontal delineations.

13. The method of claim 1, wherein said steps (c), (e) and (f) among others, includes joining the three constituent triangles of each group together such as that they have a common vertex formed by the mutual coincidence of the individual apexes of each triangle; and folding said three triangles along their common edges in the same direction to form a trihedral corner reflector facet whose front face projection forms an equilateral triangle.

14. A method of assembling and constructing a tetracaidecadeltatrihedral corner reflector as depicted in FIGS. 8*a*–8*c* and FIGS. 9*a*–9*c* comprising the steps of:

(a) preparing three uniform size square planar reflecting base plates and joining them in a row at their edges such that a central plate is flanked by the two remaining plates;

(b) preparing and collectively placing on top of each square plate four planar 45° right triangle reflective plates each being of a size corresponding to a quadrant of said square base plates and collectively not exceeding the size of each square plate; hingedly attaching one edge of each triangle plate to said square plate in a manner that the hinged edges essentially form an uninterupted 90° "X", thereby enabling the triangle plates to be lifted up about their hinge lines;

(c) attaching two deltatrihedral-forming planar patterns to free opposed edges of said central square base plate, each of which patterns includes (i) three uniform size interconnected 45° right constituent triangles arranged to have a common vertex formed by the mutual coincidence of individual apexes of each triangle, and so that the sides of all of said triangles form a 90° "X" delineation; and (ii) further includes hypotenuses which correspond to and are coextensive with but do not exceed the edge dimension of said square plates;

(d) lifting and elevating the respective four triangle plates of paragraph (b) up about their hinged edges on each of said three square plates so that each triangle plate is essentially perpendicular to its base square plate, and merging and uniting vertical free edges of said triangle plates to have a common fastened vertex thereby forming four rigid trihedral reflector corners; and (e) forming the two deltatrihedral-forming patterns of paragraph (c) into their respective trihedral corner reflectors, and folding the two flank square plates respectively about the central base plate and merging and affixing the free edges of the respective flank square plates with the remaining appropriate free edges of said two deltatrihedral patterns to thereby complete a closed rigid reflector array comprising fourteen deltatrihedrals.

15. a tetracaidecadeltatrihedral corner reflector, with all 90° reentrant angles, produced according the method of claim 14.

16. A method of assembling and constructing a self-supporting, rigid hexadaidecadeltatrihedral corner reflector comprised of an assembled pair of reflective sheet material networks by the method shown in FIGS. 10*a*–10*c*, and FIGS. 11*a*–11*g*, said method comprising the steps of:

(a) forming a single square planar reflecting base plate for each network of said pair of networks;

(b) hingedly or foldably connecting to each edge of each square plate a planar deltatrihedral-forming pattern, each of which patterns includes (i) three uniform size interconnected 45° right constituent triangles arranged to have a common vertex formed by the mutual coincidence of individual apexes of each triangle and so that the sides of all of said triangles form a 90° "X" delineation; and (ii) further includes hypotenuses which correspond to and are coextensive with but do not exceed the edge dimension of said square plates;

(c) preparing and hingedly attaching on top of each square base plate four planar 45° right triangle reflective plates each being a size corresponding to a quadrant of said base plate, the attaching being along one edge of each triangle plate in a manner forming an essentially uninterrupted 90° "X", thereby enabling the triangle plates to be lifted up about their hinged connections;

(d) lifting and elevating the respective four triangle plates up about their hinged edges on each base plate so that each triangle plate is essentially perpendicular thereto, then (e) merging and affixing vertical free edges of said triangle plates to have a common vertex thereby forming four rigid trihedral reflector corners, in conjunction with the said four deltatrihedrals of paragraph (b) above, which are folded away from said merged four triangle plates, thereby constituting one network of eight corner trihedral reflectors; and (f) joining the two networks into a complementary united pair of affixing corresponding exposed edges of each network to construct said rigid sixteen cornered deltatrihedral.

17. A hexacaidecadeltatrihedral corner reflector, with all 90° reentrant angles, produced according to the method of claim 16.

18. A planar two dimensional unitary network or pattern constituting an intermediate product adaptable by preselected design for assembling different members of a family of orthogonal polydeltatrihedral corner reflectors, each of said networks being formed on at least a semi-rigid reflective surfaced sheet material capable of being self-supporting when in the folded and assembled condition, each network comprising:

(a) a plurality of orthogonally arranged parallel horizontal rows and vertical columns of deltatrihedral-forming subpatterns of which each subpattern is constituted by three delineated uniform size adjoining 45° right constituent triangles;

(b) said right triangles oriented to have a common vertex formed by the mutual coincidence of individual apexes of each triangle, and further such that the 45° sides of the respective triangles collectively form a 90° "X" figure, with the respective three hypotenuses disposed at 90° relative to one another, some of which are vertically oriented and other of which are horizontally oriented;

(c) said rows of said subpatterns terminating in oppositely disposed parallel vertical free edges;

(d) said columns of said subpatterns terminating in top and bottom free edges substantially all of which have 90° "V" shapes; and (e) all non-free edges of said delineated triangles including means facilitating folding or hinged interconnection between all interconnected triangles and subpatterns.

19. A network or pattern as defined in claim 18, wherein all of said rows and said columns of said subpatterns are alternately offset from one another, as in FIGS. 3*b*–3*f* and 5*a*.

20. A network or pattern as defined in claim 18, wherein all of said columns of said subpatterns are alternately offset from one another in a predetermined repetitive pattern and all top and bottom free edges terminate in 90° "V" shapes, as in FIGS. 3*b*–3*f* and 5*a*.

21. The network of claim 20, wherein there are twenty such columns, and six similarly offset rows, each column having four deltatrihedral subpatterns separated by a medially disposed 90° diamond shaped cutout portion to facilitate the folding and assembly thereof into an orthogonal polydeltatrihedral radar reflector have a second order tesselation, as shown in FIG. 5*a*.

22. A family of two-dimensional planar intermediate product networks of the type defined in claim 18, including at least (a) a first network comprising eight deltatrihedral subpatterns, as depicted in FIG. 3*b*;

(b) a second network comprising fourteen deltrihedral subpatterns, as depicted in FIG. 3*c*; and (c) a third network comprising sixteen deltratrihedral subpatterns, as depicted in FIG. 3*d*.

23. A family of two dimensional planar intermediate product networks as defined in claim 22, further including (d) a fourth network comprising twenty deltatrihedral subpatterns, as depicted in FIG. 3*e*; and (e) a fifth network comprising twenty-four deltatrihedral subpatterns, as depicted in FIG. 3*f*.

Figure 9A:
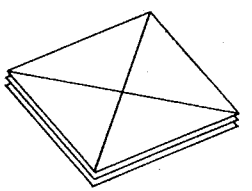
Figure 9B:
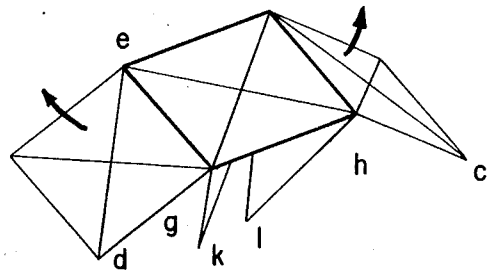
Figure 9C:
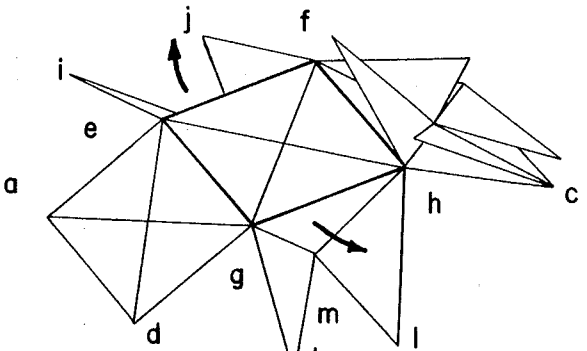
Figure 9D:
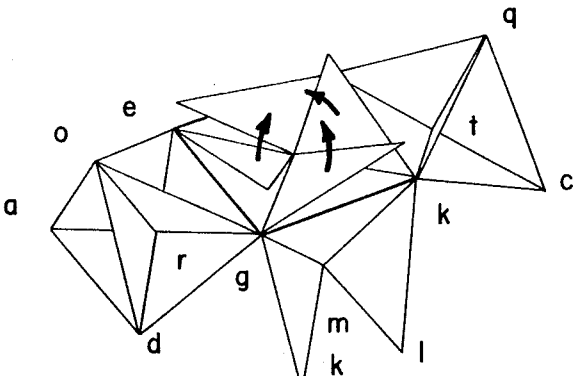
Figure 9E:
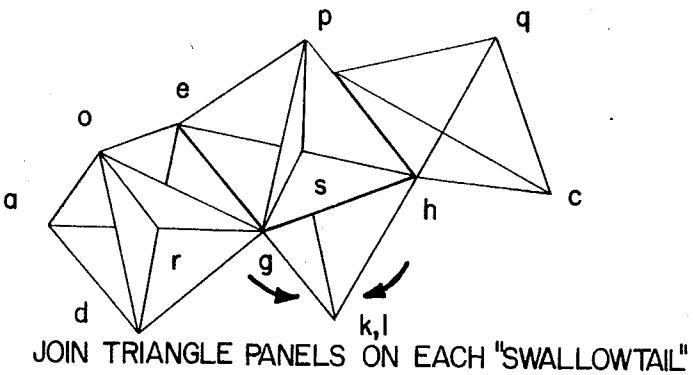
Figure 9F:
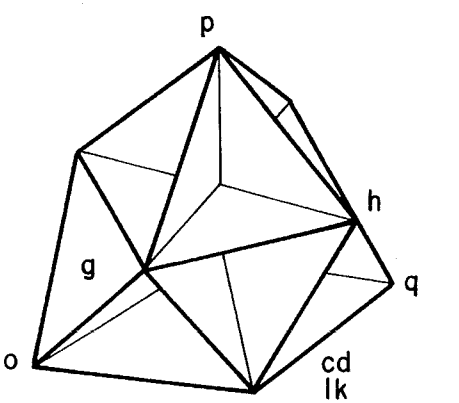

24. An orthogonal polydeltatrihedral radar device comprising fourteen deltatrihedral corner reflectors disposed on the surface thereof, as shown in FIGS. 8*c*, 9*f*, and 2*c*.

25. An orthogonal polydeltatrihedral radar device comprising sixteen deltatrihedral corner reflectors disposed on the surface thereof, as shown in FIGS. 2*d* and 11*g*.

26. An orthogonal polydeltatrihedral radar device comprising twenty-four deltatrihedral corner reflectors disposed on the surface thereof, as shown in FIG. 2*f*.

Figure 7:
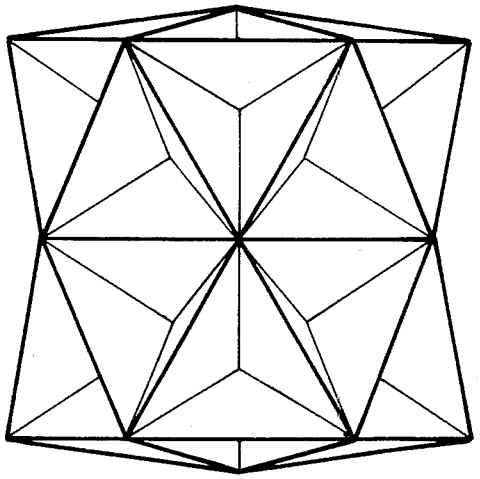
FIG. 7 represents a variation of the tetraicosadeltatrihedral of FIG. 3*f*, this having 36 corners.

27. An orthogonal polydeltatrihedral radar device comprising thirty-six deltatrihedral corner reflectors disposed on the surface thereof and all having 90° reentrant angles, as shown in FIG. 7.

* * * * *